US008876504B2

(12) United States Patent
Uozumi et al.

(10) Patent No.: US 8,876,504 B2
(45) Date of Patent: Nov. 4, 2014

(54) PUMP ROTOR COMBINING AND ECCENTRICALLY DISPOSING AN INNER AND OUTER ROTOR

(75) Inventors: Masato Uozumi, Itami (JP); Harumitsu Sasaki, Itami (JP); Kentaro Yoshida, Itami (JP)

(73) Assignee: Sumitomo Electric Sintered Alloy, Ltd., Takahashi-shi (JP)

( * ) Notice: Subject to any disclaimer, the term of this patent is extended or adjusted under 35 U.S.C. 154(b) by 244 days.

(21) Appl. No.: 13/496,438

(22) PCT Filed: Nov. 2, 2010

(86) PCT No.: PCT/JP2010/069481
§ 371 (c)(1),
(2), (4) Date: Mar. 15, 2012

(87) PCT Pub. No.: WO2011/058908
PCT Pub. Date: May 19, 2011

(65) Prior Publication Data

US 2012/0177525 A1 Jul. 12, 2012

(30) Foreign Application Priority Data

Nov. 16, 2009 (JP) ..... 2009-260944

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 2/10*** | (2006.01) |
| ***F04C 15/00*** | (2006.01) |
| ***F04C 2/08*** | (2006.01) |

(52) U.S. Cl.
CPC ..... *F04C 2/102* (2013.01); *F04C 15/0049* (2013.01); *F04C 2/084* (2013.01)
USPC ..... 418/150; 418/166; 418/171

(58) Field of Classification Search
CPC ..... F04C 2/102; F04C 2/084; F04C 2/086; F04C 2/3441; F04C 18/084; F01C 21/106; F01C 1/084; F16H 1/32; F16H 55/08
USPC ..... 418/150, 166, 171; 475/180, 904
See application file for complete search history.

(56) References Cited

U.S. PATENT DOCUMENTS 4,432,712 A 2/1984 Eisenmann
4,657,492 A * 4/1987 Saegusa ..... 418/150

(Continued)

FOREIGN PATENT DOCUMENTS

JP 62-057835 U 12/1987
JP 3293507 6/2002

(Continued)

OTHER PUBLICATIONS

Office Action in Chinese Patent Application No. 201080039574.X, dated Feb. 8, 2014.

*Primary Examiner* — Theresa Trieu
(74) *Attorney, Agent, or Firm* — Venable LLP; Michael A. Sartori; George L. Howarah

(57) ABSTRACT

An object is to meet the demands for increasing the number of teeth of a rotor in an internal gear pump while maintaining a theoretical discharge amount by using an equivalent body configuration so as to enhance the pump performance relating to discharge pulsation due to the increased number of teeth. In a pump rotor 1 formed by combining of an inner rotor (2) having N teeth and an outer rotor (3) having (N+1) teeth and disposing the rotors eccentrically relative to each other, the relational expression $\phi D_{max}<1.7e\cdot\sin(\pi/180)/\sin\{\pi/(180\cdot N)\}$ is satisfied, $\phi D_{max}$ being a maximum value of a working pitch diameter of the inner rotor (2) and the outer rotor (3), and a working position (G) of the inner rotor (2) and the outer rotor (3) is always located rearward of an eccentric axis (CL) in a rotating direction of the rotor.

2 Claims, 9 Drawing Sheets

(56) References Cited

U.S. PATENT DOCUMENTS

| | | | | |
|---|---|---|---|---|
| 5,368,455 | A | 11/1994 | Eisenmann | |
| 6,890,164 | B2 * | 5/2005 | Ogata et al. | 418/150 |
| 2004/0067150 | A1 * | 4/2004 | Hirabayashi et al. | 418/171 |
| 2009/0116989 | A1 * | 5/2009 | Ono et al. | 418/150 |

FOREIGN PATENT DOCUMENTS

| | | | | |
|---|---|---|---|---|
| JP | 2003-254258 | A | 9/2003 | |
| JP | 2008-128041 | A | 6/2008 | |
| WO | WO-2007/034888 | A1 | 3/2007 | |
| WO | WO 2010016473 | A1 * | 2/2010 | 418/150 |

* cited by examiner

PUMP ROTOR COMBINING AND ECCENTRICALLY DISPOSING AN INNER AND OUTER ROTOR

TECHNICAL FIELD

The present invention relates to a pump rotor formed by combining an inner rotor having N teeth and an outer rotor having (N+1) teeth and disposing the rotors eccentrically relative to each other, and to an internal gear pump using the same.

BACKGROUND ART

Internal gear pumps equipped with the aforementioned pump rotor in which the difference in the number of teeth is one are widely used as oil pumps for vehicle engines or for automatic transmissions (AT). Patent Literatures (PTLs) 1 to 3 below disclose examples of such an internal gear pump in the related art.

In an internal gear pump disclosed in PTL 1, tooth profiles of an inner rotor and an outer rotor are each formed by using a base circle, a locus of one point on an externally rolling circle that rolls in contact with the base circle without slipping, and a locus of one point on an internally rolling circle.

In an internal gear pump disclosed in PTL 2, addendum and dedendum cycloidal tooth profiles are formed by using two base circles having different diameters, an externally rolling circle that rolls in contact with one of the base circles without slipping, and an internally rolling circle that rolls in contact with the other base circle without slipping, and the addendum and dedendum cycloidal tooth profiles are connected with each other by using an involute curve.

In an internal gear pump disclosed in PTL 3, a tooth profile of an outer rotor is formed by using a convexed arc curve or a cycloidal curve. Then, a tooth profile of an inner rotor is determined by rolling the inner rotor within the tooth profile of the outer rotor.

In addition to these examples, an internal gear pump that uses a trochoidal-curve tooth profile is also known.

CITATION LIST

Patent Literature

PTL 1: Japanese Patent No. 3293507

PTL 2: Japanese Unexamined Patent Application Publication No. 2008-128041

PTL 3: Japanese Examined Patent Application Publication No. 62-57835

SUMMARY OF INVENTION

Technical Problem

In pump rotors in the related art that use a trochoidal tooth profile or a cycloidal tooth profile, a working position of the inner rotor and the outer rotor is located forward of an eccentric axis in the rotating direction of the rotor or at a position that overlaps the eccentric axis.

The term "eccentric axis" used here refers to a line extending through the centers of the inner rotor and the outer rotor in the case where the rotors are disposed eccentrically relative to each other in design.

Furthermore, when the inner rotor and the outer rotor are disposed eccentrically relative to each other in design and the outer rotor is rotated toward the inner rotor in a direction opposite to the rotating direction, the working position is a first contact point between the inner rotor and the outer rotor. Assuming that the distance from the center of the inner rotor to the working position is defined as r, a working pitch diameter $\phi D$ is 2r. A minimum value and a maximum value of the working pitch diameter measured while rotating the inner rotor in small amounts in the rotating direction are defined as $\phi D_{min}$ and $\phi D_{max}$, respectively.

In the internal gear pumps in the related art in which the working position is located forward of the eccentric axis in the rotating direction of the rotor or at a position that overlaps the eccentric axis, discharge pulsation decreases with increasing number of teeth of the rotor. However, if the number of teeth in the rotor is increased while ensuring a required discharge amount, the working pitch diameter becomes larger, resulting in an increased outer diameter of the rotor.

In contrast, in pumps equipped in vehicles, an increased outer diameter of a rotor is undesirable since compactness and weight reduction are particularly desired in such pumps. Due to these circumstances, demands for increasing the number of teeth in a rotor while maintaining a theoretical discharge amount with the same outer diameter of the rotor have not been met.

An object of the present invention is to meet the demands for increasing the number of teeth in a rotor while maintaining a theoretical discharge amount and the same outer diameter of the rotor as that in the related art so that the pump performance relating to discharge pulsation is enhanced due to the increased number of teeth.

Solution to Problem

In order to achieve the aforementioned object, the present invention achieves improvements in a pump rotor formed by combining an inner rotor having N teeth and an outer rotor having (N+1) teeth and disposing the rotors eccentrically relative to each other, as well as in an internal gear pump using the pump rotor. Specifically, when the centers of the inner rotor and the outer rotor are set in an eccentric arrangement, a working position of the inner rotor and the outer rotor is always located rearward of an eccentric axis in a rotating direction of the rotor.

A maximum value $\phi D_{max}$ of a working pitch diameter of the inner rotor and the outer rotor satisfies the following relational expression:

$$\phi D_{max} < 1.7e \cdot \sin(\pi/180)/\sin\{\pi/(180 \cdot N)\} \quad \text{(Expression 1)}$$

so that the above-described configuration in which the working position of the inner rotor and the outer rotor is always located rearward of the eccentric axis in the rotating direction of the rotor can be achieved.

Here, e denotes an amount of eccentricity between the inner rotor and the outer rotor, and N denotes the number of teeth in the inner rotor.

For the inner rotor in the pump rotor according to the present invention, one of or both of an addendum curve and a dedendum curve of a tooth profile is/are preferably formed by a method in FIG. 2(*a*) and FIG. 2(*b*) (this method will be described in detail later).

With regard to the outer rotor in the pump rotor according to the present invention, a tooth profile of the outer rotor is preferably formed by an envelope of tooth-profile curves of the inner rotor made by causing the inner rotor to rotate while revolving along a circle that is concentric with the outer rotor. This will also be described in detail later.

Advantageous Effects of Invention

In the rotor of the internal gear pump in the related art that uses a trochoidal curve or a cycloidal curve for a tooth profile, the working position of the inner rotor and the outer rotor is always located forward of the eccentric axis in the rotating direction of the rotor or in a region extending from a position rearward to a position forward of the eccentric axis in the rotating direction of the rotor.

In the case where the working position is located forward of the eccentric axis in the rotating direction of the rotor or at a position that overlaps the eccentric axis, the maximum value $\phi_{max}$ of the working pitch diameter satisfies the following relational expression:

$$\phi D_{max} \geq 1.7e \cdot \sin \alpha / \sin(\alpha/N)$$

where e denotes an amount of eccentricity between the inner rotor and the outer rotor, N denotes the number of teeth in the inner rotor, and $\alpha$ (radian) denotes a minute angle, assuming that $\alpha=\pi/180$ here.

Based on this relational expression, when the amount of eccentricity e is fixed and the number N of teeth in the inner rotor is increased, the outer diameter of the rotor inevitably needs to be increased since the working pitch diameter becomes larger.

When the working pitch diameter is fixed and the number N of teeth in the inner rotor is increased, the amount of eccentricity e is reduced, resulting in a reduced theoretical discharge amount. Specifically, with the pump rotor in the related art, when the number N of teeth of the rotor is increased, the demand of either the body configuration of the rotor or the theoretical discharge amount cannot be satisfied.

As a countermeasure against this problem, a type that satisfies the aforementioned expression (1) prevents the working pitch diameter from becoming larger when the amount of eccentricity e is fixed and the number N of teeth in the inner rotor is increased. Furthermore, when the working pitch diameter $\phi$D is fixed and the number N of teeth in the inner rotor is increased, the amount of eccentricity e is prevented from becoming smaller. Therefore, the number N of teeth can be increased without causing an increase in the outer diameter of the rotor or a decrease in the discharge amount, thereby achieving stable discharge pressure and increased discharge amount.

The pump rotor described above as a preferred example has a high degree of flexibility in designing the tooth profile and can readily satisfy the aforementioned expression (1).

BRIEF DESCRIPTION OF DRAWINGS

FIG. 2(*b*) is an image view illustrating how the center of an addendum formation circle moves in the aforementioned method.

FIG. 5(*b*) illustrates a working pitch diameter at a position where the inner rotor has been rotated by 6° from the state in FIG. 5(*a*).

FIG. 5(*c*) illustrates a working pitch diameter at a position where the inner rotor has been rotated by 15° from the state in FIG. 5(*a*).

FIG. 5(*d*) illustrates a working pitch diameter at a position where the inner rotor has been rotated by 18° from the state in FIG. 5(*a*).

FIG. 5(*e*) illustrates a working pitch diameter at a position where the inner rotor has been rotated by 24° from the state in FIG. 5(*a*).

FIG. 5(*f*) illustrates a working pitch diameter at a position where the inner rotor has been rotated by 30° from the state in FIG. 5(*a*).

FIG. 6(*b*) illustrates a working pitch diameter at a position where the inner rotor has been rotated by 10° from the state in FIG. 6(*a*).

FIG. 6(*c*) illustrates a working pitch diameter at a position where the inner rotor has been rotated by 20° from the state in FIG. 6(*a*).

FIG. 6(*d*) illustrates a working pitch diameter at a position where the inner rotor has been rotated by 30° from the state in FIG. 6(*a*).

FIG. 6(*e*) illustrates a working pitch diameter at a position where the inner rotor has been rotated by 35° from the state in FIG. 6(*a*).

FIG. 6(*f*) illustrates a working pitch diameter at a position where the inner rotor has been rotated by 40° from the state in FIG. 6(*a*).

DESCRIPTION OF EMBODIMENTS

Figure 1:
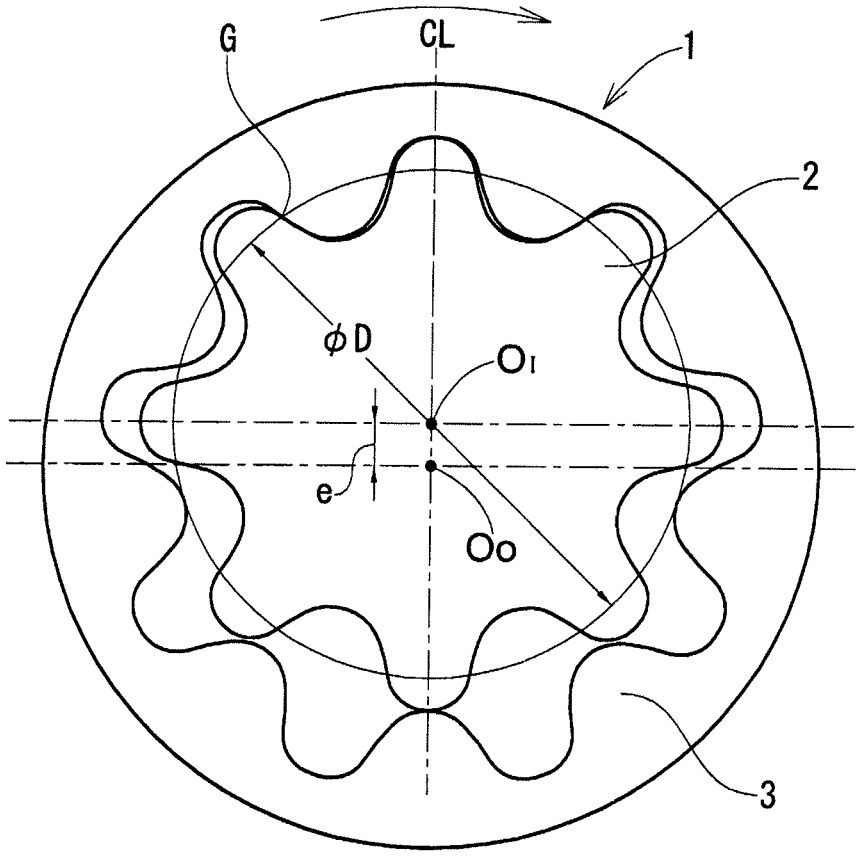
FIG. 1 is an end view illustrating an example of a pump rotor according to the present invention.

A pump rotor and an internal gear pump using the same according to embodiments of the present invention will be described below with reference to the attached drawings of FIGS. 1 to 6(*f*). A pump rotor 1 shown in FIG. 1 is formed by combining an inner rotor 2 and an outer rotor 3, which has one tooth more than the inner rotor, and eccentrically disposing the rotors relative to each other. A tooth profile of the inner rotor 2 of the pump rotor 1 is formed by the following method. A detailed description of the tooth-profile forming method will be provided with reference to FIG. 2(*a*) and FIG. 2(*b*).

Figure 2A:
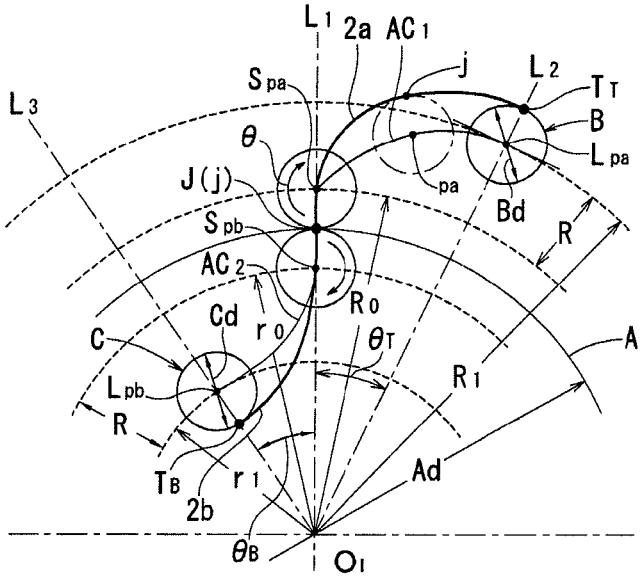
FIG. 2(*a*) illustrates a tooth-profile forming method for an inner rotor used in the pump rotor in FIG. 1.
Figure 2B:
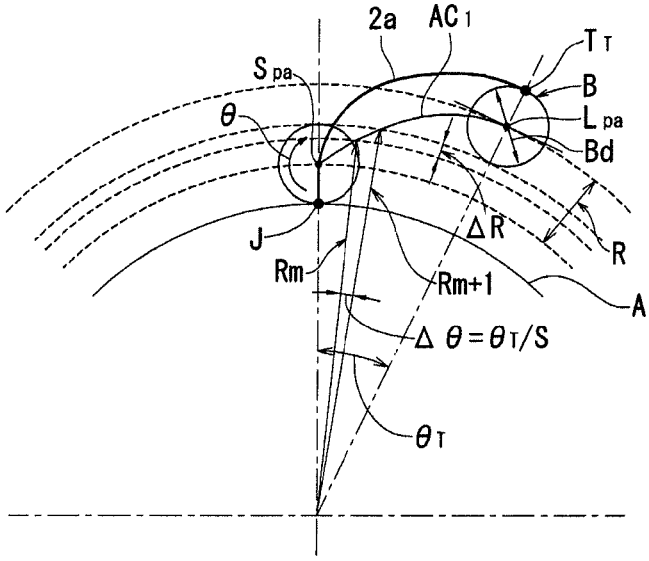

The tooth-profile forming method in FIG. 2(*a*) and FIG. 2(*b*) involves moving each formation circle B, C having a diameter Bd, Cd and having, on the circumference thereof, a point j aligned with a reference point J on a reference circle A, which has a diameter Ad and is centered on a center $O_I$ of the inner rotor, so that the following conditions (1) to (3) are satisfied, and drawing a locus curve formed by the point j during that time. Subsequently, the locus curve is inverted symmetrically with respect to a line $L_2$, $L_3$ extending from the center $O_I$ of the inner rotor to an addendum point $T_T$ or a dedendum point $T_B$. A curve that is symmetrical with respect to the line $L_2$, $L_3$ becomes one of or both of an addendum curve and a dedendum curve of the tooth profile of the inner rotor 2.

Movement Conditions of Formation Circles B and C (1) Each formation circle (B, C) is disposed such that the point (j) on the formation circle is in alignment with the reference point (J) on the reference circle (A). A center (pa, pb) of the formation circle at that time is set as a movement start point (Spa, Spb). Subsequently, the formation circle (B, C) is disposed such that the point (j) on the formation circle is positioned at the addendum point ($T_T$) or the dedendum point ($T_B$), and the center (pa, pb) of the formation circle at that time is set as a movement end point (Lpa, Lpb). Then, the center (pa, pb) of the formation circle moves along a formation-circle-center movement curve ($AC_1$, $AC_2$) extending from the movement start point (Spa, Spb) to the movement end point (Lpa, Lpb), and the formation circle (B, C) rotates at a constant angular velocity in the same direction as the moving direction of the circle.

(2) As the formation circle (B, C) moves from the movement start point (Spa, Spb) to the movement end point (Lpa, Lpb), the formation-circle-center movement curve ($AC_1$, $AC_2$) increases in the distance between the center ($O_I$) of the inner rotor and the center (pa, pb) of the formation circle for the addendum curve and decreases in the distance for the dedendum curve.

(3) The distance between the addendum point ($T_T$) and the center $O_I$ of the inner rotor is larger than a sum of the radius of the reference circle A and the diameter of the formation circle at the time of the start of the movement, or the distance between the dedendum point ($T_B$) and the center $O_I$ of the inner rotor is smaller than a difference between the radius of the reference circle A and the diameter of the formation circle at the time of the start of the movement.

In the tooth-profile formation of the inner rotor 2 using this method, the addendum formation circle B moves in an angle $\theta_T$ range from the movement start point Spa to the movement end point Lpa while rotating at a constant angular velocity toward the line $L_2$, and also moves by a distance R in the radial direction of the reference circle A during this time.

The addendum formation circle B rotates by an angle θ during the travel from the movement start point Spa to the movement end point Lpa. Specifically, the point j on the formation circle rotates by the angle θ so as to reach the addendum point $T_T$. A curve constituting half of the addendum curve of the inner rotor is drawn by the locus of the point j formed during the movement of the addendum formation circle B from the movement start point Spa to the movement end point Lpa.

In this case, the rotating direction of the addendum formation circle B is the same as the moving direction thereof in the angle $\theta_T$ range.

Specifically, when the rotating direction is clockwise, the moving direction of the addendum formation circle B is also clockwise.

The curve drawn in this manner is inverted with respect to the line $L_2$. Specifically, the curve is made into a symmetrical shape with respect to the line $L_2$. Consequently, the addendum curve of the inner rotor 2 is formed.

The dedendum curve can be drawn in a similar manner. The dedendum formation circle C having a diameter ϕCd is moved in an angle $\theta_B$ range from the movement start point Spb to the movement end point Lpb while being rotated at a constant angular velocity in a direction opposite to the rotating direction of the addendum formation circle B. The point j on the circumference of the dedendum formation circle C travels from the position where the point j is aligned with the reference point J on the reference circle A to the dedendum point $T_B$ set on the line $L_3$, and a curve constituting half of the dedendum curve of the inner rotor is drawn by the locus of the point j.

Each of the formation circles B and C used in this method is either a circle that moves from the movement start point to the movement end point while maintaining its diameter constant or a circle that moves from the movement start point to the movement end point while reducing its diameter (preferably, a circle whose diameter at the movement end point is not smaller than 0.2 times the diameter thereof at the movement start point).

Preferably, each of the curves $AC_1$ and $AC_2$ is a curve using a sine function and satisfies the following expression with regard to an amount of change ΔR in the distance from the center $O_I$ of the inner rotor to the curve $AC_1$, $AC_2$:

$$\Delta R = R \times \sin((\pi/2) \times (m/s)) \quad \text{(Expression 2)}$$

where

R: (a distance ($R_1$) from the center ($O_I$) of the inner rotor to the movement end point (Lpa) at the center (pa) of the formation circle)—(a distance ($R_0$) from the center ($O_I$) of the inner rotor to the movement start point (Spa) at the center (pa) of the formation circle) or (a distance ($r_0$) from the center ($O_I$) of the inner rotor to the movement start point (Spb) at the center (pb) of the formation circle)—(a distance ($r_1$) from the center ($O_I$) of the inner rotor to the movement endt point (Lpb) at the center (pb) of the formation circle), s: the number of steps, and m=→s.

The number of steps s refers to the number of segments into which an angle ($\theta_T$: ∠Spa, $O_I$, and Lpa, and $\theta_B$: ∠Spb, $O_I$, and Lpb) formed by the movement start point (Spa, Spb), the center ($O_I$) of the inner rotor, and the movement end point (Lpa, Lpb) is equally segmented.

Each of the curves $AC_1$ and $AC_2$ may alternatively be a cosine curve, a high-order curve, an arc curve, an elliptic curve, or a curve formed by a combination of these curves and a straight line having a fixed inclination.

Furthermore, it is preferable that the formation circles B and C be moved along the curves $AC_1$ and $AC_2$ in which a change rate ΔR' of the amount of change ΔR becomes zero at the movement end points Lpa and Lpb.

By making each of the curves $AC_1$ and $AC_2$ in FIG. 2(*a*) such that the amount of change ΔR in expression (2) becomes zero at the movement end point Lpa, Lpb at the center of the corresponding formation circle, the addendums or the dedendums drawn by the locus of the point j on the addendum formation circle B or the dedendum formation circle C are prevented from becoming sharp. Therefore, the advantages of preventing noise during pump operation and enhancing durability of the rotor are achieved.

If each of the formation circles B and C moves from the movement start point (Spa, Spb) to the movement end point (Lpa, Lpb) while reducing its diameter, an amount of change Δr in the diameter thereof preferably satisfies the following expression:

$$\Delta r = ((\text{diameter at movement start point}) - (\text{diameter at movement end point})) \times \sin((\pi/2) \times (m/s)) \quad \text{(Expression 3)}$$

where s denotes the number of steps, and m=0→s.

Referring to FIG. 2(*a*), with a line connecting the reference point J on the reference circle A and the center $O_I$ of the inner rotor being defined as a line $L_1$, the addendum point $T_T$ and the dedendum point $T_B$ are respectively set on the line $L_2$ rotated from the line $L_1$ by an angle $\theta_T$ and on the line $L_3$ rotated from the line $L_1$ by an angle $\theta_B$. Furthermore, the angle $\theta_T$ between the line $L_1$ and the line $L_2$ and the angle $\theta_B$ between the line $L_1$ and the line $L_3$ are set in view of the number of teeth and the ratio of areas where the addendums and the dedendums are to be set.

The movement start points Spa and Spb of the addendum formation circle B and the dedendum formation circle C are disposed on the line $L_1$, whereas the movement end points Lpa and Lpb are respectively disposed on the lines $L_2$ and $L_3$.

For the dedendum curve of the inner rotor 2 obtained by applying the curve formed by the method shown in FIG. 2(*a*) and FIG. 2(*b*) to the addendum curve, a curve formed with the same method for forming the addendum curve may be employed by using the dedendum formation circle C, or a cycloidal curve or a curve formed by using a known trochoidal curve may be employed as a tooth-profile curve. Likewise, for the addendum curve of the inner rotor 2 obtained by applying the tooth-profile curve formed by the method shown in FIG. 2(*a*) and FIG. 2(*b*) to the dedendum curve, a cycloidal curve or a curve formed by using a trochoidal curve may be employed.

Figure 3:
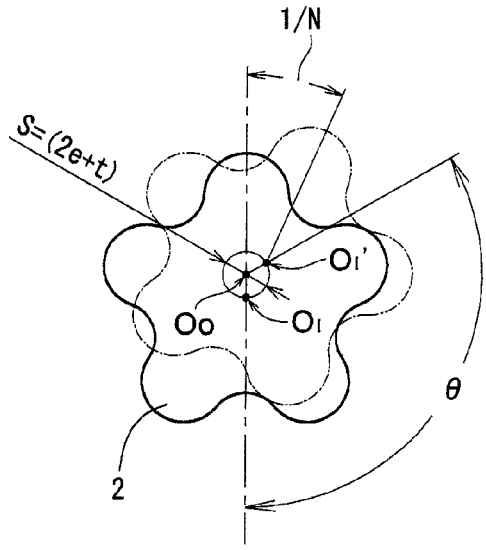
FIG. 3 illustrates a tooth-profile forming method for an outer rotor used in the pump rotor in FIG. 1.

A method of forming a tooth-profile curve for the outer rotor 3 is shown in FIG. 3. The center $O_O$ of the inner rotor 2 revolves along a circle S having a diameter (2e+t) and centered on a center $O_O$ of the outer rotor 3. Subsequently, while the center $O_I$ of the inner rotor makes one revolution along the circle S, the inner rotor 2 makes a 1/N rotation. An envelope of tooth-profile curves of the inner rotor formed in this manner serves as a tooth-profile curve for the outer rotor.

Specifically, e: amount of eccentricity between the center of the inner rotor and the center of the outer rotor, t: maximum clearance between the teeth of the outer rotor and the inner rotor pressed thereto, and N: the number of teeth in the inner rotor.

The pump rotor with the tooth profile formed in this manner has a degree of flexibility in setting the tooth profiles of the inner rotor and the outer rotor and in setting a working pitch diameter ϕD.

With regard to the working pitch diameter ϕD of the inner rotor and the outer rotor, a design process is performed so that the following relational expression is satisfied:

$$\phi D_{max} < 1.7e \cdot \sin(\pi/180)/\sin\{\pi/(180 \cdot N)\} \quad \text{(Expression 1)}$$

In the pump rotor fabricated in this manner, the inner rotor 2 and the outer rotor 3 engage at a position rearward of an eccentric axis CL in the rotating direction of the rotor.

By performing the design process that satisfies the aforementioned expression (1) for the working pitch diameter, the working pitch diameter does not become too large and thus has no effect on the body of the rotor when the amount of eccentricity e is fixed and the number N of teeth in the inner rotor is increased. Furthermore, when the working pitch diameter is fixed and the number N of teeth in the inner rotor is increased, the amount of eccentricity e is prevented from becoming smaller. When the amount of eccentricity e or a maximum value $\phi D_{max}$ of the working pitch diameter is fixed in the expression (1), the expression is still satisfied even if the value of N is increased in that state. Therefore, the number N of teeth can be increased without having to making the body of the rotor larger or reducing the theoretical discharge amount.

Figure 4:
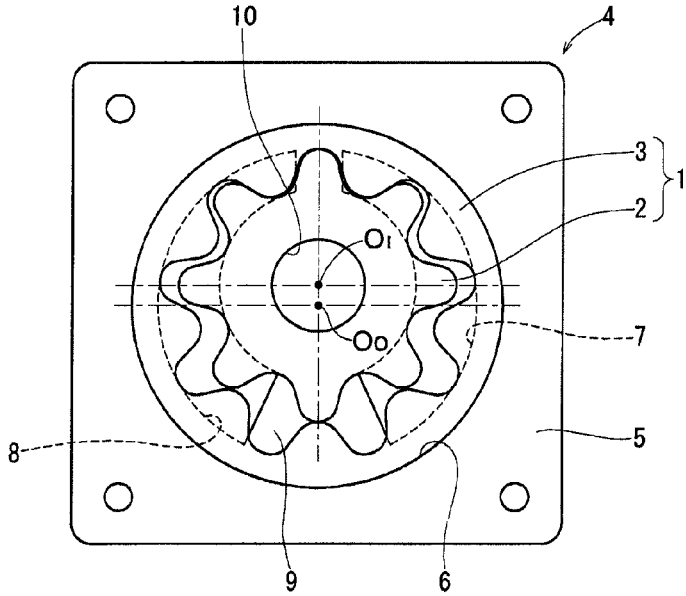
FIG. 4 is an end view illustrating a state where a cover of a pump casing is removed from an internal gear pump that uses the pump rotor in FIG. 1.
Figure 5A:
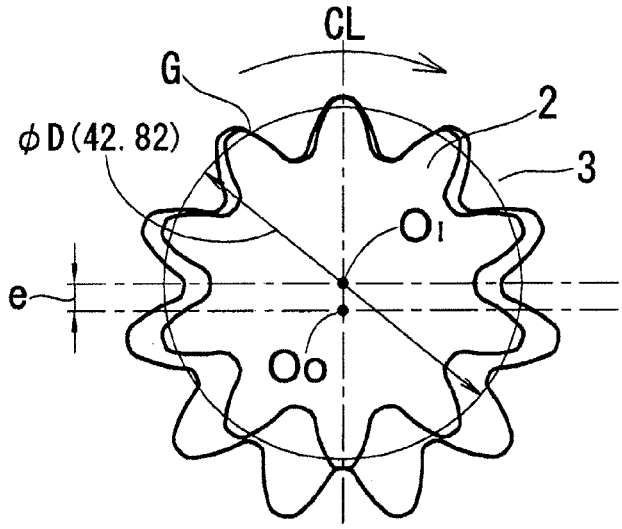
FIG. 5(*a*) is an end view illustrating a tooth profile of a pump rotor of sample No. 1 corresponding to a practical example of the present invention.
Figure 5B:
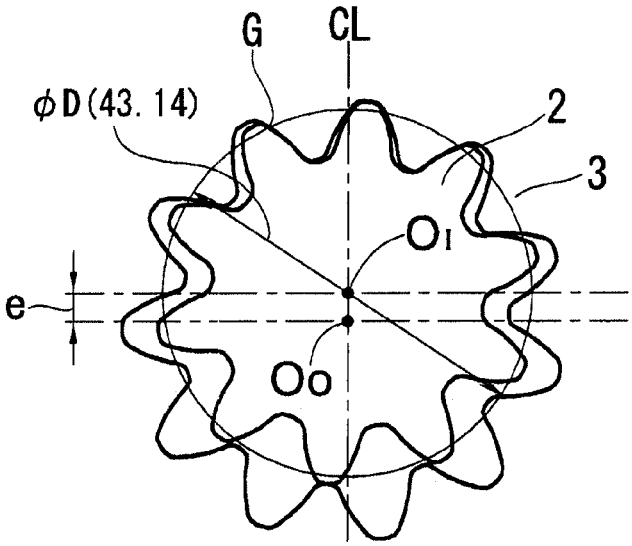
Figure 5C:
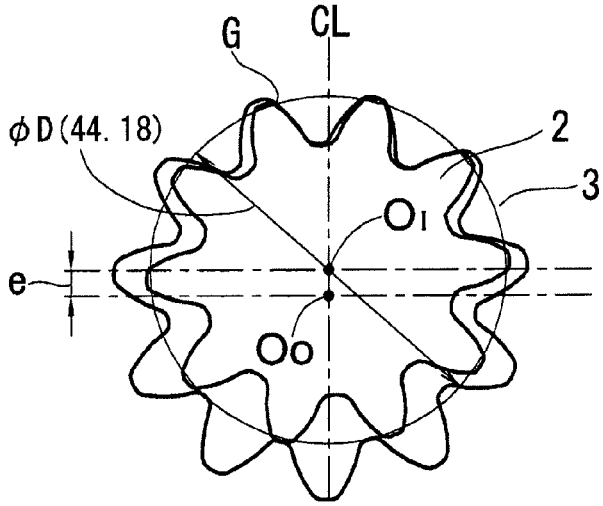
Figure 5D:
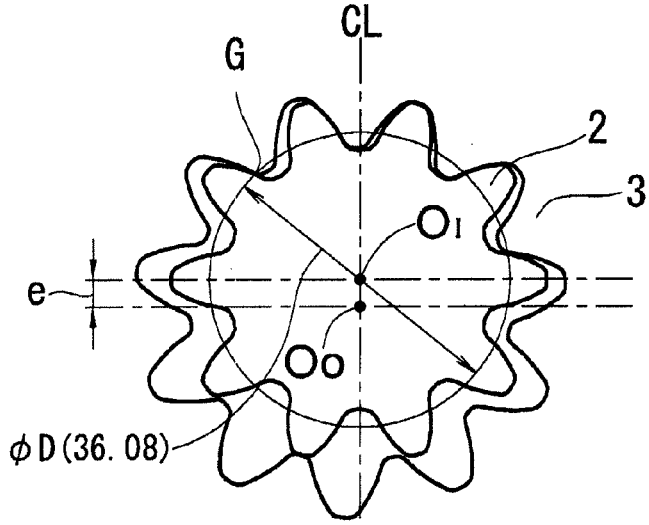
Figure 5E:
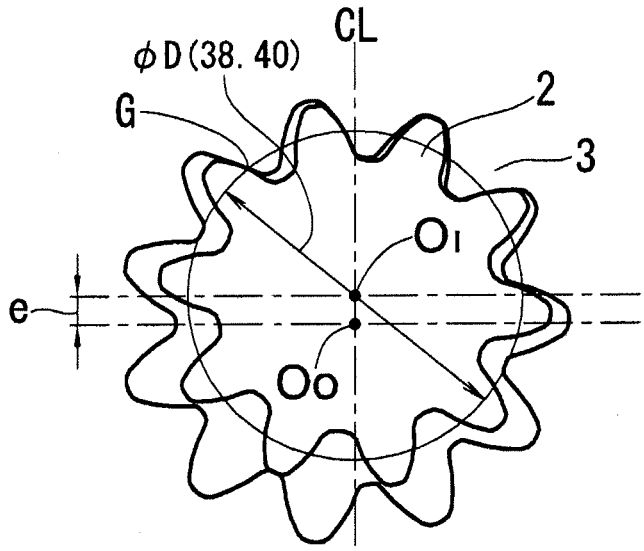
Figure 5F:
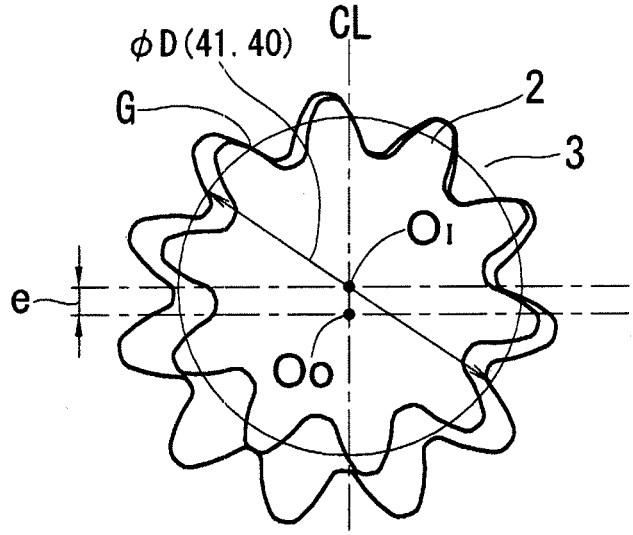
Figure 6A:
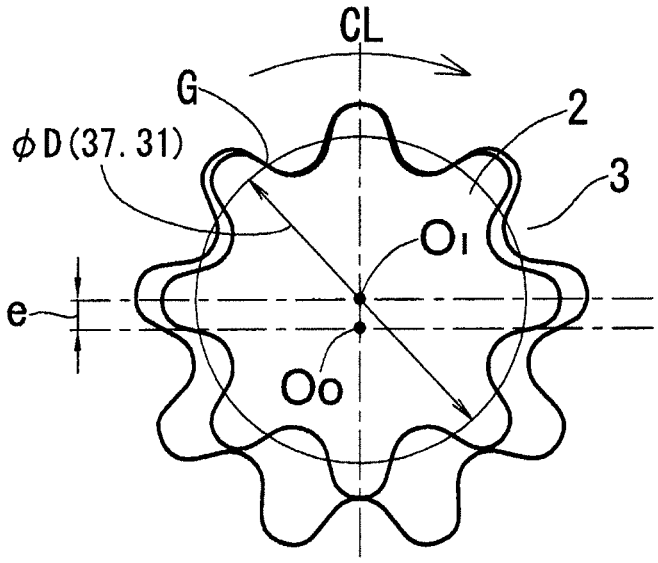
FIG. 6(*a*) is an end view illustrating a tooth profile of a pump rotor of sample No. 2 corresponding to a practical example of the present invention.
Figure 6B:
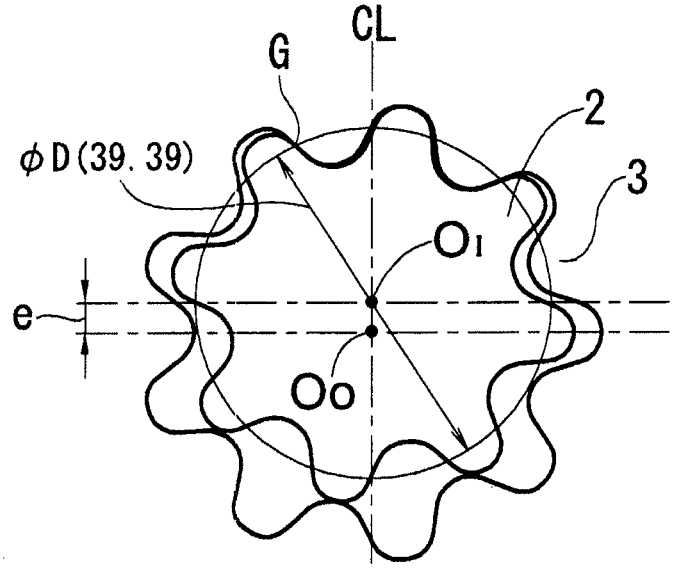
Figure 6C:
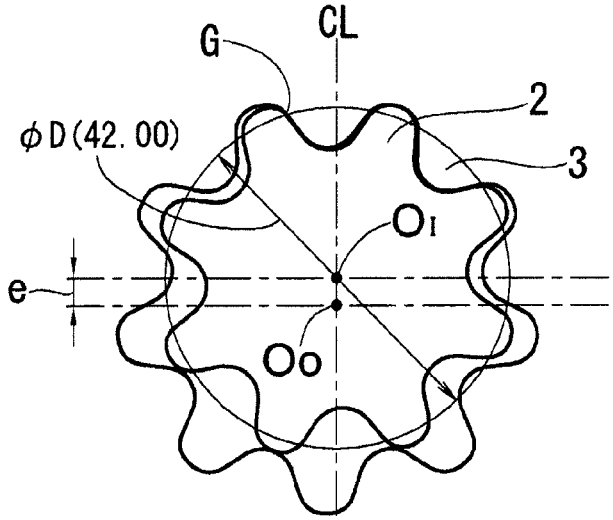
Figure 6D:
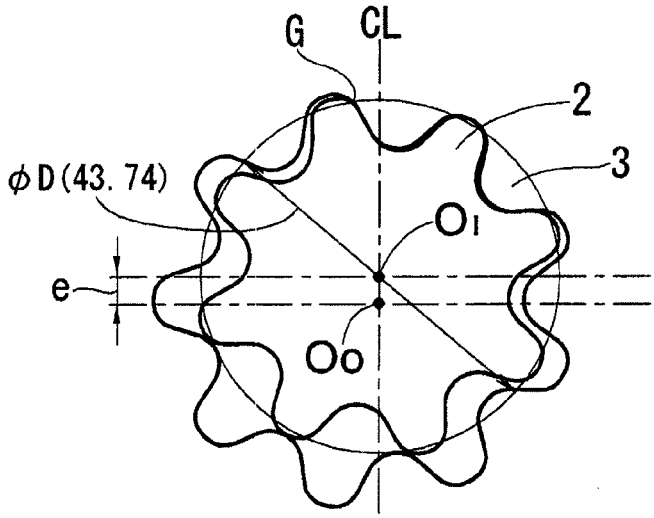
Figure 6E:
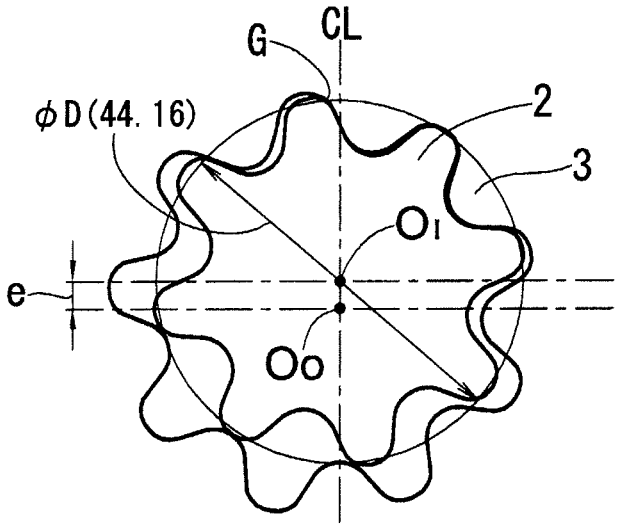
Figure 6F:
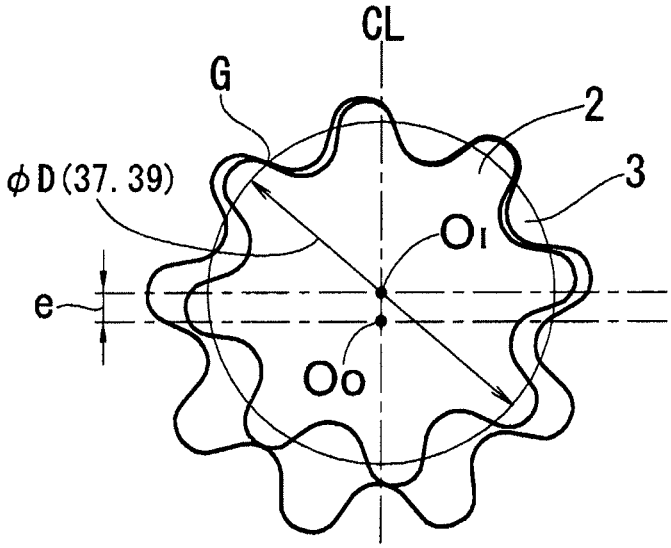

An example of an internal gear pump that uses the pump rotor 1 shown in FIG. 1 is shown in FIG. 4. An internal gear pump 4 is formed by accommodating the pump rotor 1 in a rotor chamber 6 formed in a pump casing 5. The pump casing 5 includes a cover (not shown) that covers the rotor chamber 6.

An intake port 7 and a discharge port 8 are formed in a side surface of the rotor chamber 6 provided in the pump casing 5. A pump chamber 9 is formed between the inner rotor 2 and the outer rotor 3. This pump chamber 9 increases or decreases in capacity as the rotor rotates. In an intake process, the capacity of the pump chamber 9 increases, and a liquid, such as oil, is taken into the pump chamber 9 through the intake port 7.

In a discharge process, the capacity of the pump chamber 9 decreases as the rotor rotates, so that the liquid within the pump chamber 9 is delivered to the discharge port 8. In FIG. 4, reference numeral 10 denotes a shaft hole formed in the inner rotor 2, and a drive shaft (not shown) that rotates the rotor extends through this shaft hole 10.

PRACTICAL EXAMPLE 1

FIGS. 5(*a*) to 6(*f*) illustrate a practical example of the pump rotor according to the present invention. The pump rotor 1 in FIG. 5 includes a combination of the inner rotor 2 having 10 teeth and the outer rotor 3 having 11 teeth, and the pump rotor 1 in FIG. 6 includes a combination of the inner rotor 2 having eight teeth and the outer rotor 3 having nine teeth.

Regarding the pump rotor 1 in FIG. 5(*a*) to FIG. 5(*f*), the tooth-profile curves for both the addendums and the dedendums of the inner rotor 2 are formed using the method in FIGS. 2(*a*) and 2(*b*). Moreover, sine curves are used such that the amount of change ΔR in the distance from the center of the inner rotor to the respective curves $AC_1$ and $AC_2$ becomes zero at the corresponding movement end points. Design specifications are shown under sample No. 1 in Table I.

Regarding the pump rotor 1 in FIG. 6(*a*) to FIG. 6(*f*), the tooth-profile curves for both the addendums and the dedendums of the inner rotor 2 are formed using the method in FIGS. 2(*a*) and 2(*b*). Moreover, sine curves are used such that the amount of change ΔR becomes zero at the corresponding movement end points. Design specifications are shown under sample No. 2 in Table I. Regarding the outer rotor 3 in the pump rotor according to each of sample 1 and sample 2, the tooth-profile curve is formed using the method in FIG. 3 that uses the envelope of tooth profiles of the inner rotor.

Regarding the inner rotor 2 according to each of sample Nos. 3 to 5, the tooth-profile curves for both the addendums and the dedendums thereof are formed using the method in FIGS. 2(*a*) and 2(*b*). Design specifications are shown in Table I.

TABLE I

| Sample No. | 1 | 2 | 3 | 4 | 5 |
|---|---|---|---|---|---|
| Number N of Teeth in Inneer Rotor | 10 | 8 | 8 | 14 | 12 |
| Addendum Diameter (mm) of Inner Rotor | 45.08 | 45.08 | 33.41 | 58.93 | 49.52 |
| Dedendum Diameter (mm) of Inner Rotor | 31.48 | 31.48 | 22.41 | 47.97 | 39.64 |
| Dedendum Diameter (mm) of Outer Rotor | 51.94 | 51.92 | 39 | 64.53 | 54.64 |
| Addendum Diameter (mm) of Outer Rotor | 38.34 | 38.32 | 28 | 53.57 | 44.76 |
| Amount of Eccentricity e (mm) | 3.4 | 3.4 | 2.75 | 2.74 | 2.47 |
| Diameter (mm) of Reference Circle A | 36 | 37 | 26.83 | 52.4 | 44 |
| Diameter (mm) of Formation Circle B at Movement Start Point | 1.98 | 2.31 | 1.68 | 1.87 | 1.83 |

TABLE I-continued

| Sample No. | 1 | 2 | 3 | 4 | 5 |
|---|---|---|---|---|---|
| Diameter (mm) of Formation Circle B at Movement End Point | 1.5 | 2.3 | 1.3 | 1.5 | 1.7 |
| Amount of Charge Δ in Diameter of Formation Circle B | Expression 3 | Expression 3 | Expression 3 | Expression 3 | Expression 3 |
| Moving Distance R (mm) of Center of Formation Circle B | 3.68 | 2.75 | 2.35 | 2.2 | 1.75 |
| Curve $AC_1$ | Expression 2 | Expression 2 | Expression 2 | Expression 2 | Expression 2 |
| θ T (°) | 9.9 | 11.25 | 11.25 | 6.43 | 7.5 |
| Diameter (mm) of Formation Circle C at Movement Start Point | 1.62 | 2.31 | 1.68 | 1.87 | 1.83 |
| Diameter (mm) of Formation Circle C at Movement End Point | 1.5 | 2.3 | 1.1 | 1.6 | 1.7 |
| Amount of Charge Δ in Diameter of Formation Circle C | Expression 3 | Expression 3 | Expression 3 | Expression 3 | Expression 3 |
| Moving Distance R (mm) of Center of Formation Circle C | 1.12 | 1.06 | 1.18 | 0.8 | 0.93 |
| Curve $AC_2$ | Expression 2 | Expression 2 | Expression 2 | Expression 2 | Expression 2 |
| θ B (°) | 8.1 | 11.25 | 11.25 | 6.43 | 7.5 |
| Number of Steps s | 30 | 30 | 30 | 30 | 30 |
| Maximum Working Pitch Diameter $\phi D_{max}$ (mm) | 44.18 | 44.16 | 32.53 | 57.11 | 47.43 |
| Minimum Working Pitch Diameter $\phi D_{Min}$ (mm) | 36.08 | 37.39 | 27.07 | 52.49 | 44.25 |
| Theoretical Discharge Amount (cc/rev/cm) | 8.52 | 8.21 | 4.89 | 9.29 | 6.89 |

The dimensions of each component and the theoretical discharge amount have been rounded off to the second decimal place (the same applies hereinafter).

The theoretical discharge amount in Table I is a numerical value of a rotor thickness per 10 mm. A large diameter of the outer rotor indicates a dedendum diameter of the outer rotor, a small diameter of the outer rotor indicates an addendum diameter of the outer rotor, a large diameter of the inner rotor indicates an addendum diameter of the inner rotor, and a small diameter of the inner rotor indicates a dedendum diameter of the inner rotor.

FIG. 5(*a*) to FIG. 5(*f*) illustrate changes in the engagement state of the pump rotor. In the position shown in FIG. 5(*a*), when the working pitch diameter ϕD is 42.82 mm, the teeth of the inner rotor 2 and the outer rotor 3 engage with each other so that the clearance between the teeth of the two rotors is zero.

A section corresponding to zero clearance between the teeth is a working position G.

FIGS. 5(*b*) to 5(*f*) illustrate states where the inner rotor 2 is rotated from the position in FIG. 5(*a*) by 6°, 15°, 18°, 24°, and 30°, respectively. The working pitch diameter ϕD is 43.14 mm in the position in FIG. 5(*b*), is at a maximum of 44.18 mm in the position in FIG. 5(*c*), is at a minimum of 36.08 mm in the position in FIG. 5(*d*), is 38.40 mm in the position in FIG. 5(*e*), and is 41.40 mm in the position in FIG. 5(*f*), and the working position G is located rearward of the eccentric axis CL in the rotating direction of the rotor in all of these positions.

When the position in FIG. 5(*c*) in which the working pitch diameter ϕD is at the maximum is passed, the working position G shifts to the position in FIG. 5(*d*) in which the working pitch diameter ϕD is at the minimum. Thus, the working position G is prevented from moving forward past the eccentric axis CL in the rotating direction of the rotor.

The same applies to the pump rotor 1 in FIG. 6. FIGS. 6(*b*) to 6(*f*) illustrate states where the inner rotor 2 is rotated from the position in FIG. 6(*a*) by 10°, 20°, 30°, 35°, and 40°, respectively. The working pitch diameter ϕD is 37.31 mm in the position in FIG. 6(*a*), is 39.39 mm in the position in FIG. 6(*b*), is 42.00 mm in the position in FIG. 6(*c*), is 43.74 mm in the position in FIG. 6(*d*), is at a maximum of 44.16 mm in the position in FIG. 6(*e*), and is 37.39 mm in the position in FIG. 6(*f*). In this case, when the position in FIG. 6(*e*) is passed, the working position G similarly shifts rearward in the rotating direction of the rotor so as to be prevented from moving forward past the eccentric axis CL in the rotating direction of the rotor.

In all of the samples Nos. 1 to 5 in Table I, the maximum value $\phi D_{max}$ of the working pitch diameter satisfies the aforementioned expression (1), and the working position G of the inner rotor and the outer rotor is located rearward of the eccentric axis in the rotating direction of the rotor.

As a comparative example, an inner rotor based on a trochoidal tooth profile is formed by using a trochoidal curve as the tooth-profile curve of the inner rotor 2. The trochoidal tooth profile is formed in the following manner. A rolling circle B rolls along the reference circle A without slipping. A trochoidal curve is drawn by a point distant from the center of the rolling circle B by a distance equivalent to an amount of eccentricity e. An envelope of a locus circle C having its center on the trochoidal curve serves as the trochoidal tooth profile. The tooth profile of the outer rotor 3 is formed on the basis of the method in FIG. 3 by using the envelope of the tooth profiles of the inner rotor. Specifications of the tooth profile is shown in Table II below.

TABLE II

| Sample No. | Comparative Example |
|---|---|
| Number N of Teeth in Inner Rotor | 6 |
| Addendum Diameter (mm) of Inner Rotor | 45.68 |
| Dedendum Diameter (mm) of Inner Rotor | 31.16 |
| Dedendum Diameter (mm) of Outer Rotor | 52 |
| Addendum Diameter (mm) of Outer Rotor | 39.48 |
| Amount of Eccentricity e (mm) | 3.14 |
| Diameter (mm) of Reference Circle A | 47.34 |
| Diameter (mm) of Rolling Circle B (mm) | 7.89 |
| Diameter (mm) of Locus Circle C (mm) | 15.79 |
| Maximum Working Pitch Diameter $\phi D_{max}$ (mm) | 42.43 |
| Minimum Working Pitch Diameter $\phi D_{min}$ (mm) | 40.8 |
| Theoretical Discharge Amount (cc/rev/cm) | 7.6 |

TABLE II-continued

| Sample No. | Comparative Example |
|---|---|
| Calculation Result of Right-Hand Side of Expression 1 (mm) | 31.92 |

Although the teeth in the comparative example has the same size as those in samples Nos. 1 and 2, the number of teeth and the theoretical discharge amount are smaller than those in samples Nos. 1 and 2. The maximum value $\phi D_{max}$ of the working pitch diameter does not satisfy the aforementioned expression (1), and the working position G of the inner rotor and the outer rotor sometimes moves forward past the eccentric axis in the rotating direction of the rotor.

REFERENCE SIGNS LIST

1 pump rotor
2 inner rotor
3 outer rotor
4 internal gear pump
5 pump casing
6 rotor chamber
7 intake port
8 discharge port
9 pump chamber
10 shaft hole
$O_I$ center of inner rotor
$O_O$ center of outer rotor
e amount of eccentricity between inner rotor and outer rotor
N number of teeth in inner rotor

The invention claimed is:

1. A pump rotor for an internal gear pump, the pump rotor being formed by combining an inner rotor (2) having N teeth and an outer rotor (3) having (N+1) teeth and disposing the rotors eccentrically relative to each other, wherein a working position (G) of the inner rotor (2) and the outer rotor (3) is always located rearward of an eccentric axis (CL) in a rotating direction of the inner rotor, and wherein a maximum value $\phi D_{max}$ of a working pitch diameter $\phi D$ of the inner rotor (2) and the outer rotor (3) satisfies the following relational expression:

$$\phi D_{max} < 1.7e \cdot \sin(\pi/180)/\sin\{\pi/(180 \cdot N)\} \quad \text{(Expression 1)}$$

where e denotes an amount of eccentricity between the inner rotor and the outer rotor, and N denotes the number of teeth in the inner rotor.

2. An internal gear pump comprising:

the pump rotor (1) according to claim 1; and a pump casing (5), wherein the pump casing has a pump chamber (9) that accommodates the pump rotor, an intake port (7), and a discharge port (8).

* * * * *